United States Patent [19]

Meiri

[11] Patent Number: 5,024,586

[45] Date of Patent: Jun. 18, 1991

[54] ACCURATE PERISTALTIC PUMP FOR NON ELASTIC TUBING

[76] Inventor: Samuel Meiri, 9438 Kedvale, Skokie, Ill. 60076

[21] Appl. No.: 492,860

[22] Filed: Mar. 13, 1990

[51] Int. Cl.[5] ..... F04B 43/12

[52] U.S. Cl. ..... 417/477

[58] Field of Search ..... 417/474–477; 604/153

[56] References Cited

U.S. PATENT DOCUMENTS

| | | | |
|---|---|---|---|
| 2,831,437 | 4/1958 | Cromwell et al. | 417/477 |
| 2,898,864 | 8/1959 | Japolsky | 417/475 |
| 4,315,718 | 2/1982 | Hogan | 417/477 |
| 4,492,538 | 1/1985 | Iwata | 417/477 |
| 4,549,860 | 10/1985 | Yakich | 417/477 X |
| 4,558,996 | 12/1985 | Becker | 417/477 X |
| 4,705,464 | 11/1987 | Arimond | 417/477 |

*Primary Examiner*—Leonard E. Smith
*Assistant Examiner*—Eugene L. Szczecina, Jr.

[57] ABSTRACT

A peristaltic pump which corrects the effects of creep on a peristaltic tube. A plurality of spring biased rollers apply a substantially constant force to pinch the tube. A pair of elastic semi-circular sections are retained throughout the entire semi-circular back wall of the peristaltic pump. The pair of elastic semi-circular sections fully restore the initial cross-section of the tube in the area of the race where the rollers are not pinching the tube.

1 Claim, 2 Drawing Sheets

ACCURATE PERISTALTIC PUMP FOR NON ELASTIC TUBING

This invention relates to a fluid pumping mechanism in which a tube carrying the fluid is squeezed by rollers mounted on a rotor or a linear slide or a set of cams, against a backwall, said rollers advancing along the axis of the tube forcing the fluid in the tube in front of the pinch point forward in the direction of advancement of said rollers such as described in U.S. Pat. Nos. 4,552,516, 4,179,249, 4,231,725, 3,358,609, 4,138,205 and commonly used in hospitals and laboratories. To maintain a constant rate of flow it is necessary that at least two pinch points exist at some time between the passage of two rollers or cam waves along the backwall, that no flow occurs past the pinching points and that the volume of fluid captured repeatedly between the two rollers at the inlet remains constant. To achieve the last requirement the cross section of the tubing must quickly return to its exact initial value after the pass of a roller and before the next pinch at the inlet. Because the tubing wall must be thin to allow for a complete seal at the pinch point, the tubing gradually loses its elasticity and does not return to its full initial cross section resulting in a reduced, uncontrolled rate of flow. The main object of this invention is to allow the use of any common inexpensive elastic and plastic tubing without sacrificing accuracy and at the same time allow long continuous operation. This is achieved by counteracting the effects of creep and stress relaxation. Additional objects and advantages of this invention will be shown hereinafter. The invention is described here in terms of a common roller pump using a circular tube but applies to any tube pinching device of any tube cross section in which the pinch points are advancing along the tube axis.

Figure 1:
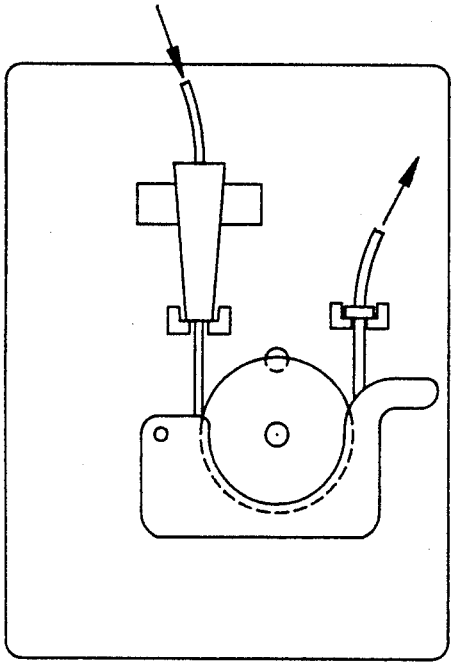

Reference is made to drawings;

FIG. 1—General arrangement of a roller peristaltic pump.

Figure 2:
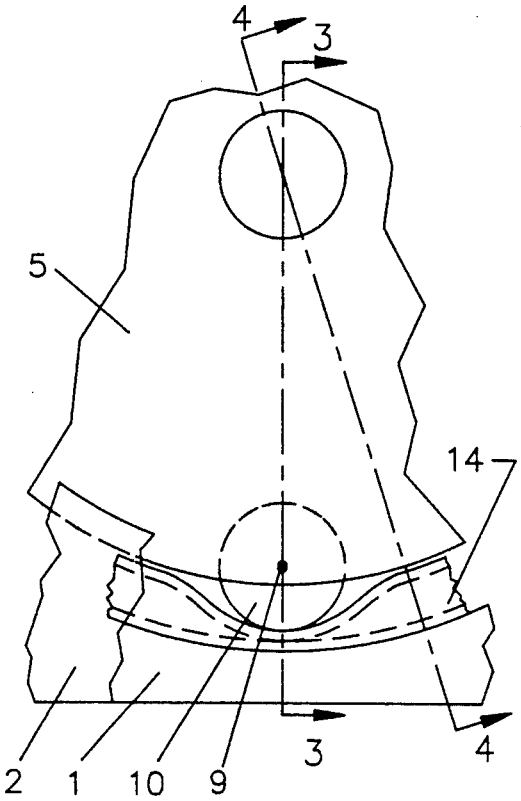

FIG. 2—Detail frontal view showing the tube in a pinched condition.

Figure 3:
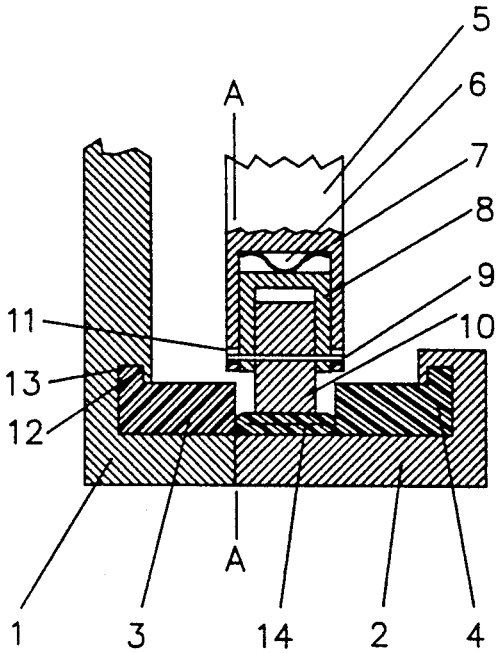

FIG. 3—A vertical cross section 3—3 through a roller.

Figure 4:
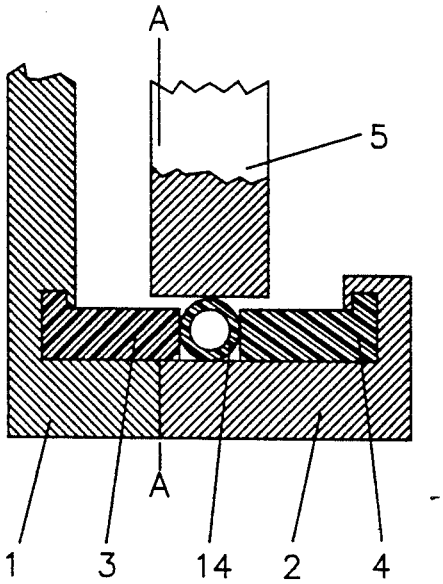

FIG. 4—Cross section 4—4 showing tubing and elastomeric supports in their relaxed normal condition.

Figure 5:
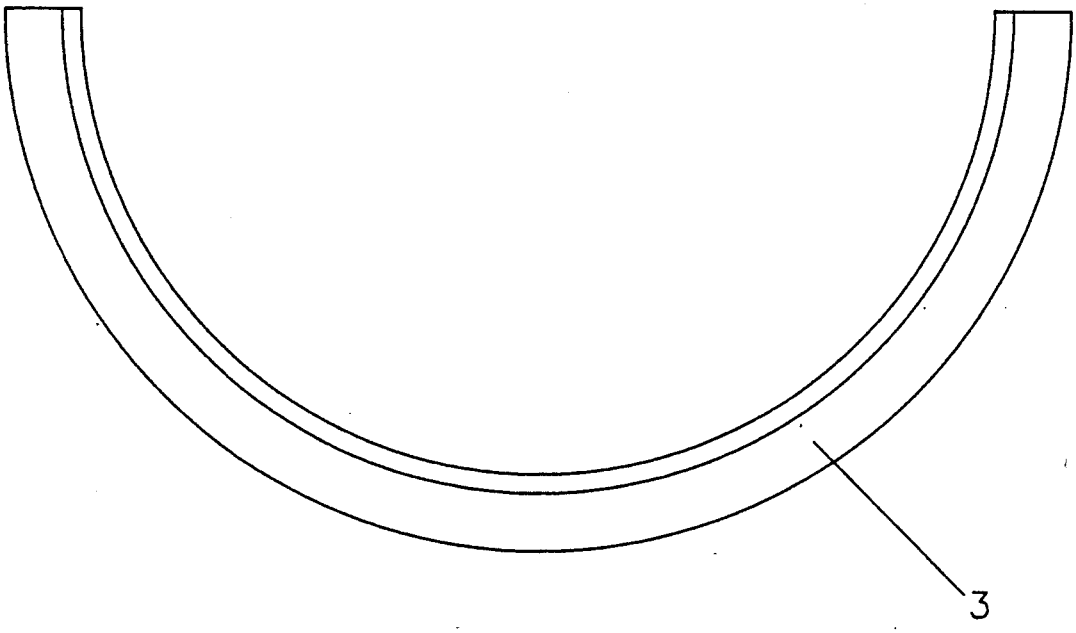

FIG. 5—Frontal view showing elastomeric support 3.

In existing art there is no supporting backwall, or the backwall is rotatable to allow insertion of tubing. According to the teaching of this invention the backwall is split in a plane A—A perpendicular to the rotor shaft, into a fixed part 1 and a rotatable part 2. The rotatable moveable part 2 rotates around the hinge point shown to the left of the rotor in FIG. 1 to allow placement and removal of tubes as common to many peristaltic pumps. The fixed backwall retains an elastic semicircular section 3 while the rotatable backwall 1 carries a symmetric elastic section 4. The tube 14 is threaded around the rotor and when the rotatable portion 2 is snapped into position the tube 14 is in contact with the backwall and the elastic sections in the race as shown in FIG. 4. Rotor 5 has a number of equally spaced cavities 6 along its periphery. Each cavity contains a leaf spring 7 forcing a yoke 8 outwardly. The yoke holds a shaft 9 on which roller 10 is free to rotate. The shaft extends into two slots 11 in the rotor body that allow a limited radial movement of the shaft and roller. FIG. 3 depicts the tube in a pinched position with the roller 10 exerting a fixed radial force as necessary to flatten the tube. Unlike existing art, this force is substantially independent of variations in the tube wall thickness thus minimizing excessive deformation of the tubing due to such variation, as well as other geometrical tolerances that are unavoidable in the manufacture and assembly of all the parts subject to the radial load. As the roller 10 advances the elastic bars 3 and 4 extend back to their original position 3 forcing the tube back to its full initial circular cross section. The elastic sections 3 and 4 have a tab 12 retained in a recess 13 so that they can be removed for routine service such as cleaning and replacing. The elastic sections shown here are made of elastomeric polymer material such as rubber or polyurathane but a set of suitable springs can be substituted.

The combined action of spring loaded rollers applying an optimal constant force and the elastomeric side bars serves to retard creep in the tubing material and retain tube cross section, thus achieving accuracy of liquid flow rate and duration not possible before.

Referring to the above preferred embodiment but not limited to it what I claim is:

1. A peristaltic pump comprising:

a motor driving a rotor, said rotor carrying a plurality of spring biased rollers on its circumference;

a semi-circular back wall, said semi-circular back wall having a fixed part and a rotatable moveable part;

a pair of elastic semi-circular sections are retained through the entire semi-circular back wall, the first of said elastic semi-circular sections retained in the fixed part and the second of said elastic semi-circular sections retained in the rotatable moveable part;

a peristaltic tube is mounted between said plurality of rollers of said rotor and said semi-circular back wall, along said tubes peripheral edges are said pair of elastic semi-circular sections which continuously elastically support said tube along the entire race;

means for correcting the effects of creep in said peristaltic tube, wherein said means for correcting creep include said spring biased rollers, which apply a substantially constant force to pinch said tube, and said means for correcting creep further include said pair of elastic semi-circular sections which fully restore the initial cross-section of said tube in the areas of said race where said rollers are not pinching said tube; and wherein said spring biased rollers apply a force which is substantially independent of minor tube wall thickness variations.

* * * * *